US008197054B2

(12) United States Patent
Taniuchi et al.

(10) Patent No.: US 8,197,054 B2
(45) Date of Patent: Jun. 12, 2012

(54) IMAGE FIXING METHOD, METHOD FOR PRODUCING RECORD PRODUCT USING SUCH METHOD, AND IMAGE RECORDING APPARATUS

(75) Inventors: Hiroshi Taniuchi, Yokohama (JP); Akihiro Mouri, Fuchu (JP)

(73) Assignee: Canon Kabushiki Kaisha, Tokyo (JP)

( * ) Notice: Subject to any disclaimer, the term of this patent is extended or adjusted under 35 U.S.C. 154(b) by 958 days.

(21) Appl. No.: 12/162,647

(22) PCT Filed: Jun. 7, 2007

(86) PCT No.: PCT/JP2007/061947

§ 371 (c)(1),
(2), (4) Date: Jul. 30, 2008

(87) PCT Pub. No.: WO2007/142358

PCT Pub. Date: Dec. 13, 2007

(65) Prior Publication Data

US 2009/0175663 A1 Jul. 9, 2009

(30) Foreign Application Priority Data

Jun. 9, 2006 (JP) ..... 2006-161342

(51) Int. Cl.
*B41J 2/01* (2006.01)
*B05D 3/02* (2006.01)

(52) U.S. Cl. ..... 347/103; 347/65; 347/88; 347/89; 347/95; 347/96; 347/99; 347/100; 347/101; 347/102; 347/104; 347/105; 427/384

(58) Field of Classification Search ..... 347/65, 347/88–89, 95–96, 99–103; 427/384
See application file for complete search history.

(56) References Cited

U.S. PATENT DOCUMENTS

| | | | | |
|---|---|---|---|---|
| 7,419,257 | B2 * | 9/2008 | Mouri et al. | 347/103 |
| 7,780,286 | B2 * | 8/2010 | Yahiro | 347/103 |
| 7,926,933 | B2 * | 4/2011 | Taniuchi et al. | 347/103 |
| 7,997,717 | B2 * | 8/2011 | Taniuchi et al. | 347/103 |
| 2004/0090508 | A1 | 5/2004 | Chowdry et al. | 347/103 |
| 2005/0110855 | A1 * | 5/2005 | Taniuchi et al. | 347/103 |

(Continued)

FOREIGN PATENT DOCUMENTS

JP 10-100379 A 4/1998

(Continued)

OTHER PUBLICATIONS

International Preliminary Report on Patentability, issued by the International Bureau, dated Dec. 24, 2008, in International Application No. PCT/JP2007/061947.

(Continued)

*Primary Examiner* — Ryan Lepisto
*Assistant Examiner* — Guy Anderson
(74) *Attorney, Agent, or Firm* — Fitzpatrick, Cella, Harper & Scinto

(57) ABSTRACT

To provide a method for fixing an image, wherein the image has a high fastness even immediately after being recorded, and is free from inconveniences such as thermal influence or unfavorable curing inherent to the conventional fixing device, as well as safety problems. To achieve such an object, in a method for fixing an image recorded on a recording medium with a recording material containing a component curable by a plasma processing, the image is fixed on the recording medium by the plasma processing at a normal pressure.

2 Claims, 5 Drawing Sheets

U.S. PATENT DOCUMENTS

| | | | | |
|---|---|---|---|---|
| 2005/0129859 | A1 * | 6/2005 | Misev et al. | 427/384 |
| 2006/0152566 | A1 * | 7/2006 | Taniuchi et al. | 347/103 |
| 2007/0058019 | A1 | 3/2007 | Saitoh et al. | 347/101 |

FOREIGN PATENT DOCUMENTS

| | | | |
|---|---|---|---|
| JP | 2003-145714 | A | 5/2003 |
| WO | WO 2004/113082 | | 12/2004 |
| WO | WO 2004113082 | * | 12/2004 |

OTHER PUBLICATIONS

International Search Report and Written Opinion of PCT/JP2007/061947.

* cited by examiner

IMAGE FIXING METHOD, METHOD FOR PRODUCING RECORD PRODUCT USING SUCH METHOD, AND IMAGE RECORDING APPARATUS

TECHNICAL FIELD

The present invention relates to an image fixing method, a method for producing a record product using such a method, and an apparatus for recording an image, particularly, to such a technique for obtaining a record product with a recorded image having high fastness.

BACKGROUND ART

A method for fixing an image recorded on a recording medium is roughly divided into permeation, drying and curing processes.

The permeation is a process wherein a solvent component in colorant (such as ink or paint) is absorbed into the recording medium. In this case, since the fluidity of the colorant is solely changed, the fastness of the image is not basically improved. While the high image fastness would be obtained, of course, as the time has passed if a binder component or a cross-linker is contained in the colorant, it is not obtainable solely by the permeation, directly after the formation of the image.

The drying is a process wherein the solvent component in the colorant is removed from the recording medium. Also in this case, since the solvent component is solely removed from the colorant, it is difficult to obtain a high fastness directly after the formation of the image as in the case of permeation. In this case, however, if the heating which is the most popular drying means is adopted together with the curing described hereinafter, there may be cases wherein the high fastness is obtainable.

The curing is a process for changing the binder component in the colorant to be fixed. Usually, such change is the polymerization of binder resin by the apply of energy thereto, whereby the high fastness is obtainable even directly after the image formation. The energy to be applied may generally be heat, ultraviolet ray (UV) and electron beam (EB), which have merits and demerits, respectively.

Heating is the most representative means used for the curing, and has merits wherein it is capable of causing the curing reaction simultaneously with or continuously to the removal of solvent from material containing the latter, or material is selectable from a wider range. On the contrary, it has demerits wherein usable recording medium is restricted because of the damage caused by heat or the dimensional stability of the recording medium becomes inferior due to the thermal expansion.

The curing process by the irradiation of ultraviolet ray as disclosed in Japanese Patent Laid-Open No. 2003-145714 or others is more advantageous than the curing by the heating since it is accompanied with no heat. However, the colorant may be restricted since an ultraviolet ray curing ink must be used, for example. Also, if an ink layer on the recording medium is too thick or has a deep color portion having a high light-absorbent efficiency, the ultraviolet ray is difficult to reach a bottom of the ink layer, whereby the interior of the image is left uncured while the surface of the image is cured.

On the other hand, since the curing process by the irradiation of electron ray disclosed in Japanese Patent Laid-Open No. 10-100379 (1998) or others is excellent in permeability, it is possible to preferably carried out the curing even if the ink layer on the recording medium is thick or has a deep color.

Since secondary X-rays are irradiated, however, it is necessary to provide a strict shielding structure for the purpose of the operator's safety.

DISCLOSURE OF THE INVENTION

An object of the present invention is to provide an image fixing method capable of obtaining a high fastness directly after recording the image, free from any inconveniences of the conventional fixing means, such as unfavorable thermal influence or inferior curing, as well as without no problems on the safety, a method for producing a record product by using such a method, and an apparatus for recording an image.

In a first aspect of the present invention, there is provided an image fixing method comprising a step of carrying out a plasma processing to an image recorded on a recording medium with a recording material containing a component curable by the plasma processing, to fix the image on the recording medium.

In a second aspect of the present invention, there is provided a method for producing a record product, comprising the steps of: recording an image on a recording medium with a recording material containing a component curable by a plasma processing; and carrying out the plasma processing to the recorded medium.

In a third aspect of the present invention, there is provided an apparatus for recording an image, comprising: a recording section that applies a recording material containing a component curable by a plasma processing to a recording medium to record the image; and a plasma processing section that carries out the plasma processing to the image recorded on the recording medium.

In a fourth aspect of the present invention, there is provided an apparatus for recording an image, comprising: an image-forming section that forms an image on an intermediate transfer body by applying a recording material containing a component curable by a plasma processing; a transfer section that transfers the image formed on the intermediate transfer body to a recording medium; and a plasma processing section that carries out the plasma processing to the image transferred to the recording medium.

According to the present invention, it is possible to immediately fix the images recorded by various recording processes or means. Particularly, the fixing means applied to the present invention is simple in structure in comparison with the conventional ones, resulting in high fastness directly after the image recording and is free from drawbacks of the conventional fixing means such as unfavorable thermal effect or inferior curing, as well as has no problems in safety. Accordingly, there is less damage to the recording medium, which means that many kinds of recording media are usable and the recording efficiency becomes higher.

Also, if a process or means capable of generating plasma at a normal pressure is employed, there is no need of the rising time necessary for the warming-up to save energy. The downsizing of the recording device is also realized.

Further features of the present invention will become apparent from the following description of exemplary embodiments (with reference to the attached drawings).

BEST MODE FOR CARRYING OUT THE INVENTION

1. Basic Structural Element of the Present Invention

A basic structural element of the method for fixing the image according to the present invention is a process for fixing an image recorded on a recording medium by using a recording material containing a component curable by a plasma processing. Basic structural elements for embodying the method for producing the record or the image recording apparatus according to the present invention is a process or means for recording the image by using a recording material containing a component curable by the plasma processing, and a process or means for fixing the recorded image by the plasma processing.

Here, the recording material is selected in relation to the used image-recording means, provided it contains a component curable by the plasma processing. If ink is used as the recording material, the condition thereof is that it contains a curable resinous component curable by the plasma processing. If this condition is satisfied, ink of either an aqueous type or non-aqueous type may be usable. Also, there is no restriction in color or viscosity, whereby various inks may be usable.

There is no restriction in means or process for recording an ink image. Various types of recording may suitably be used, including an offset printing which is the present main current of the recording, a gravure printing, a flexographic printing, a screen printing, a photolithography, an ink jet system or an electronic photography.

There is no technical restriction also in means or processes for carrying out the plasma processing but a suitable one may be selected in accordance with the required productivity. In this regard, plasma used herein is a gas containing charged particles generated by ionization, and the definition thereof is "a state wherein the numbers of ions and electrons are equal to each other and a space is electrically neutral". The plasma irradiation in this description is an operation wherein energy generated due to the plasma processing is applied to the image recorded on the recording medium, and the plasma irradiation device is a device capable of generating such plasma.

The plasma irradiation includes not only a case wherein plasma is directly irradiated to the record but also a case wherein plasma gas generated by the plasma device is indirectly operated to the record.

2. First Embodiment of Image Recording Device

An image recording apparatus according to one embodiment of the present invention will be described with reference to FIGS. 1 to 3. However, this embodiment is solely one instance, and, of course, various inks, ink image recording means or processes, and plasma irradiation means or processes may be usable, provided the requirements defined by the present invention are satisfied.

Figure 1:
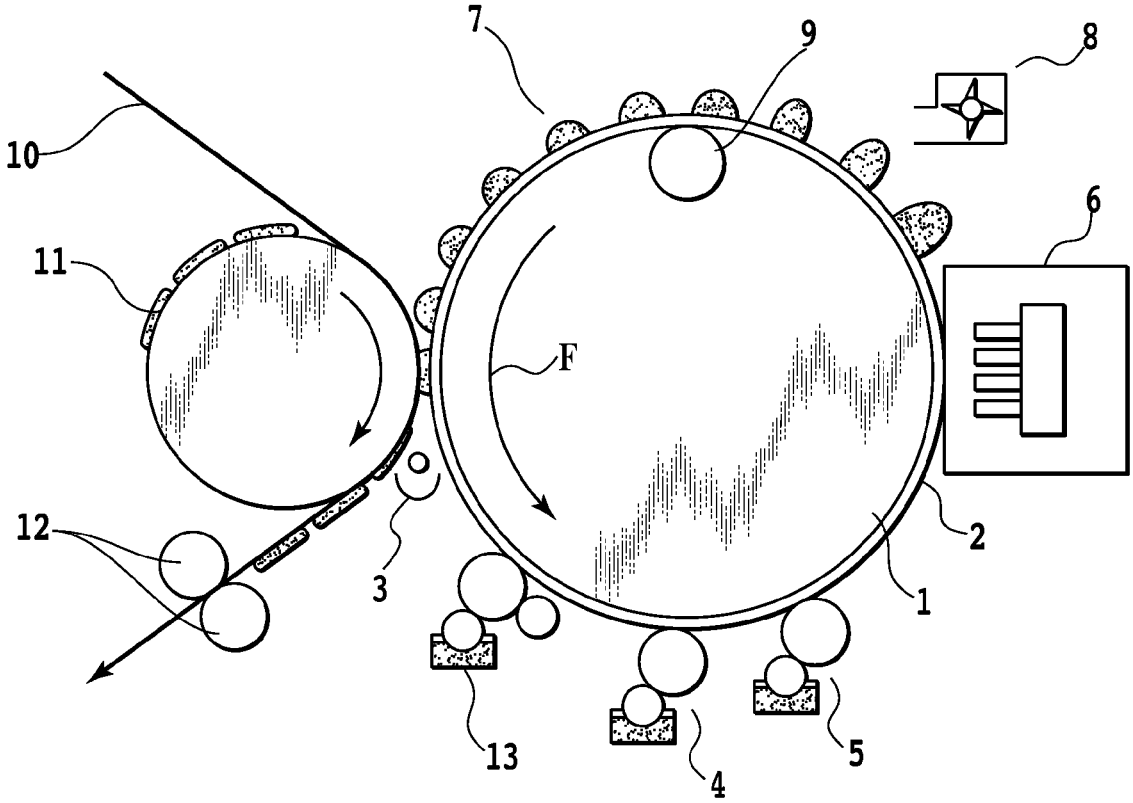
FIG. 1 is a schematic view illustrating a main structure of an image forming apparatus according to one embodiment of the present invention.

FIG. 1 is a schematic view diagrammatically illustrating one embodiment of the image recording apparatus to which the inventive fixing method is applied. The image recording apparatus according to this embodiment basically carries out a process for forming an ink image on a transfer body (also referred to as an intermediate transfer body) and a process for transfer the ink image formed on the transfer body to a desired recording medium.

In FIG. 1, reference numeral 1 indicates the cylindrical intermediate transfer body having a surface layer 2 and driven to rotate in the direction shown by an arrow F about an axis 1A. At positions opposed to an outer circumference of the intermediate transfer body 1, that is, the surface layer 2, there are provided an application device 4 for applying a wettability-improvement component, an application device 5 for applying an image-holding component and an ink jet head 6 for ejecting ink to form an ink image consisting of dots 7. That is, the intermediate transfer body 1 is made to rotate in the direction indicated by the arrow, and the surface thereof is first imparted with the wettability-improvement component by the application device 4, and thereafter, with the image-holding component by the application device 5. Further, after these components have been imparted, ink is ejected through the ink jet head 6, for example, as drops to form the ink image (a mirror-inversed mage) on the surface layer 2 of the intermediate transfer body 1. The image formed on the intermediate transfer body 1 is brought into contact with a recording surface of a recording medium 10 and transferred to the recording medium 10 by pressing the latter with a pressing roller 11 from a rear surface.

At a location of the image-forming apparatus at which the recoding medium onto which the image has been transferred is released from the surface layer 2 of the intermediate transfer body, a device 3 for irradiating plasma under a normal pressure is provided. According to this embodiment, the plasma-irradiation device 3 is disposed at a position wherein energy generated due to the plasma processing is applicable to the recorded surface of the recording medium 10 and the surface layer 2 of the intermediate transfer body after the image has been transferred.

In the apparatus shown in FIG. 1, a water removal facilitating device 8 of a blower type is disposed for the purpose of removing water or solvent component in the ink forming the image on the intermediate transfer body 1. Also in the illustrated apparatus, in addition thereto, a heat roller 9 is used, which is in contact with the rear surface of the hollow intermediate transfer body 1 and heats the same. In this regard, it is not necessary to use both thereof, but either one of them may be used.

Further, in the apparatus shown in FIG. 1, for the purpose of repeatedly using the intermediate transfer body 10 after transferring the image to the recording medium 10, the cleaning operation is carried out by a cleaning unit 13 in the following step for the preparation of receiving the next image.

Figure 2:
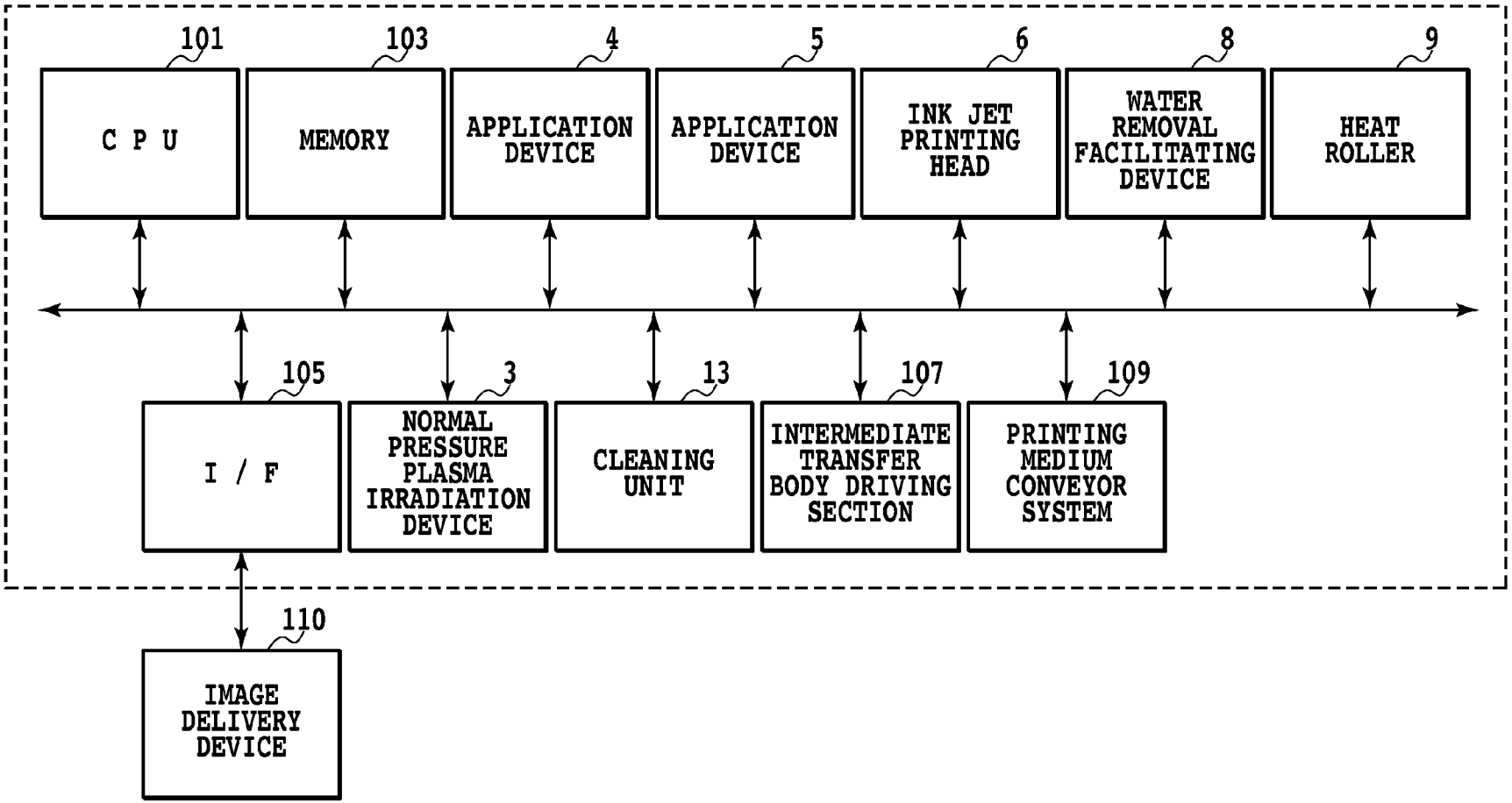
FIG. 2 is an example of a block diagram of control system constituted in correspondence to the image-forming apparatus shown I FIG. 1.

FIG. 2 shows an example configuration of a control system that may be built for the image forming apparatus of FIG. 1. In the image forming apparatus generally denoted 100, reference number 101 represents a CPU, a main control unit for the entire system. Denoted 103 is a memory including a ROM storing an operating system of CPU 101 and a RAM used to temporarily store a variety of data and to process image data and other works. Denoted 105 is an interface to send and receive data and commands to and from an image source device 110, a source of image data which may take a form of a host computer or others.

Designated 107 is a drive unit for driving the intermediate transfer body 1 in processes (a) to (c) which will be described later. Reference number 109 represents a transport system for the recording medium 10 and includes drive units for the pressure roller 11 and the fixing rollers 12. A bus line 120 interconnects the aforementioned components and the application device 4, the application device 5, the ink jet head 6, the water removal facilitating device 8, a heat roller 9, the device 3 for irradiating plasma under the normal pressure and a cleaning unit 13, and sends control signals from the CPU 101. These components may be provided with status sensors so that detected signals are transmitted to the CPU 101 through the bus line 120. If the image data sent from the image source device 110 is not mirror-inverted data, the above system executes the inversion processing and makes the mirror-inverted data.

Reasons why the illustrated image recording apparatus is capable of effectively using the inventive fixing method will be described below.

First, the reason why the ink jet recording system is used as the image recording means is that aqueous type ink is suitably used therein. Of course, there are ink jet recording apparatuses using non-aqueous ink, and the present invention is also responsive to the non-aqueous ink. However, in view of the safety for the treatment of ink or the working environment, the aqueous in is more suitable and expected to be a main current in the market.

Particularly, the aqueous ink is difficult to permeate through recording media with less in ink-absorbency such as a plastic film etc., whereby the abrasion resistance is hardly obtained. Further, since the ink jet recording system is capable of outputting different images one by one, it is often used for an on-demand recording. In such a case, the abrasion resistance immediately after the recording is particularly important. Recently, while a system wherein ultraviolet ray (UV) curing recording liquid is used has been tried, material having the UV curing property is generally low in water solubility and thus difficult to be aqueous liquid. Further, since non-reacted component is liable to be left after the UV curable material has been cured, the use thereof is largely restricted in view of safety.

Accordingly, the present invention can realize the extremely effective fixing treatment particularly when the ink jet recording is carried out while using the aqueous type ink.

Also, in the on-demand type recording, it is often required that a period in which the recording of a first sheet has been completed is shortened. However, a heater for carrying out the usual heating or a UV-irradiation lamp requires a relatively long rising time until it has been stable after the electric source is turned ON. Contrarily, the inventive fixing method hardly necessitates the rising time, whereby it is suitable also in this point.

Further, the inventive fixing method is particularly effective for a transfer type image recording apparatus to which the ink jet recording system is applied. The apparatus shown in FIG. 1 can rapidly record a clear image even on a recording medium inferior in ink-absorbency, since the ink image is formed on the intermediate transfer body and, after a solvent component in the ink image has been reduced, transferred to the recording medium. However, since the solvent component has been reduced on the intermediate transfer body, it is difficult to obtain a high fastness, particularly, abrasion resistance. To solve such inconvenience, if the inventive fixing method is applied, the image is more easily and effectively curable on the contrary, as the solvent component is reduced on the intermediate transfer body.

Also, on the image recording apparatus illustrated in FIG. 1, the application device 5 for applying the image-holding component (reactive liquid for agglomerating ink) is mounted. Thereby, it is possible to rapidly form an image free from ink runs on the intermediate transfer body having no ink-absorbency. However, in an ink system using agglomerating reaction, there may be a case wherein the polymerization or the cross-linking of the curable component in ink is disturbed and the desired abrasion resistance is not obtained. The inventive image fixing method is capable of accelerating the polymerization or the cross-linking even in such a case.

In addition thereto, in the embodiment shown in FIG. 1, the plasma irradiation device 3 is disposed as fixing means opposite also to the intermediate transfer body 1. Thereby, it is possible to use the plasma irradiation device 3 as a device for making the surface of the intermediate transfer body 1 to be hydrophilic.

To facilitate the transfer rate of the ink image, it is effective to form the intermediate transfer body while using material low in surface energy (generally having the water-repellant property). Since such a surface is liable to repel ink during the image-forming process prior to the transfer, however, it is difficult to form a favorable ink image and retain the same until the transfer process has been completed. To solve such an inconvenience, hydrophilic base is introduced into the surface by the irradiation of plasma, whereby it is possible to making the surface having a high transfer rate to be hydrophilic. That is, the surface of the intermediate transfer body is suitable for forming and retaining the ink image while maintaining inherent high ink transfer efficiency, so that it is possible to form a high-quality image without ink repellant.

For this purpose, while another plasma irradiation device may be disposed, in the structure shown in FIG. 1, one plasma irradiation device is provided not only for fixing the image on the recording medium but also for improving the surface of the intermediate transfer body. Thus, the apparatus becomes very effective on the cost and size of the thereof.

The surface containing a fluorine compound or silicone compound, which is basically employed in this embodiment, is generally water repellent and, if not treated, will repel liquids such as ink, making the forming and holding of an ink image on the surface difficult. The reason that this invention or embodiment performs the surface modification through plasma irradiation and wettability-improvement component application (surfactant application) is to overcome this very problem, i.e., to allow an ink image to be formed and held on the surface with a high ink transfer efficiency. By subjecting the intermediate transfer body having a surface containing a fluorine or silicon compound with high ink transferability to the surface modification processing consisting of the plasma treatment and surfactant application as described above, the surface of the intermediate transfer body can be made suited to ink holding while maintaining the inherently high ink transfer efficiency.

According to the image recording apparatus of such a structure as described above using the inventive fixing method, the restriction of recording media is less and it is possible to output different high-quality image on the respective recording medium. That is, without sacrificing the on-demand recording characteristic which is an advantage of the ink jet recording system, as well as without sacrificing the high speed derived from the image transfer and the convenience of freely using any of recording media, it is possible to obtain a recorded product having a good image fastness (abrasion resistance) while using a safety aqueous ink.

In this regard, the mechanism for fixing an image due to the irradiation of plasma has not been completely clear but may be thought as follows. Curable component in the ink is cured by receiving energy. While the curing reactions are various in accordance with materials, it is surmised that gas exposed to a high energy plasma state excited by a glow discharge becomes a highly-activated radical state to generate a free-radical polymerization reaction.

In the apparatus shown in FIG. 1, the intermediate transfer body after transferring the ink image is rinsed by the cleaning unit 13 disposed in the next stage and prepared for the reception of the next image. Means for carrying out the rinsing operation is preferably one wherein the surface of the body is rinsed or wiped off while directly sprayed with water or brought into contact with water surface, or one wherein a wet Moulton roller is brought into contact with the surface of the body. Of course, these may be used together.

After washing, if necessary, the surface of the intermediate transfer body may be pressed by a dry moulton roller or applied air blow for effective drying. Depending on the ink used, the component compounded for the purpose of improving the wettability may be utilized for cleaning. In that case, the wettability improving component application device 4 will also be used as the cleaning means.

Figure 3:
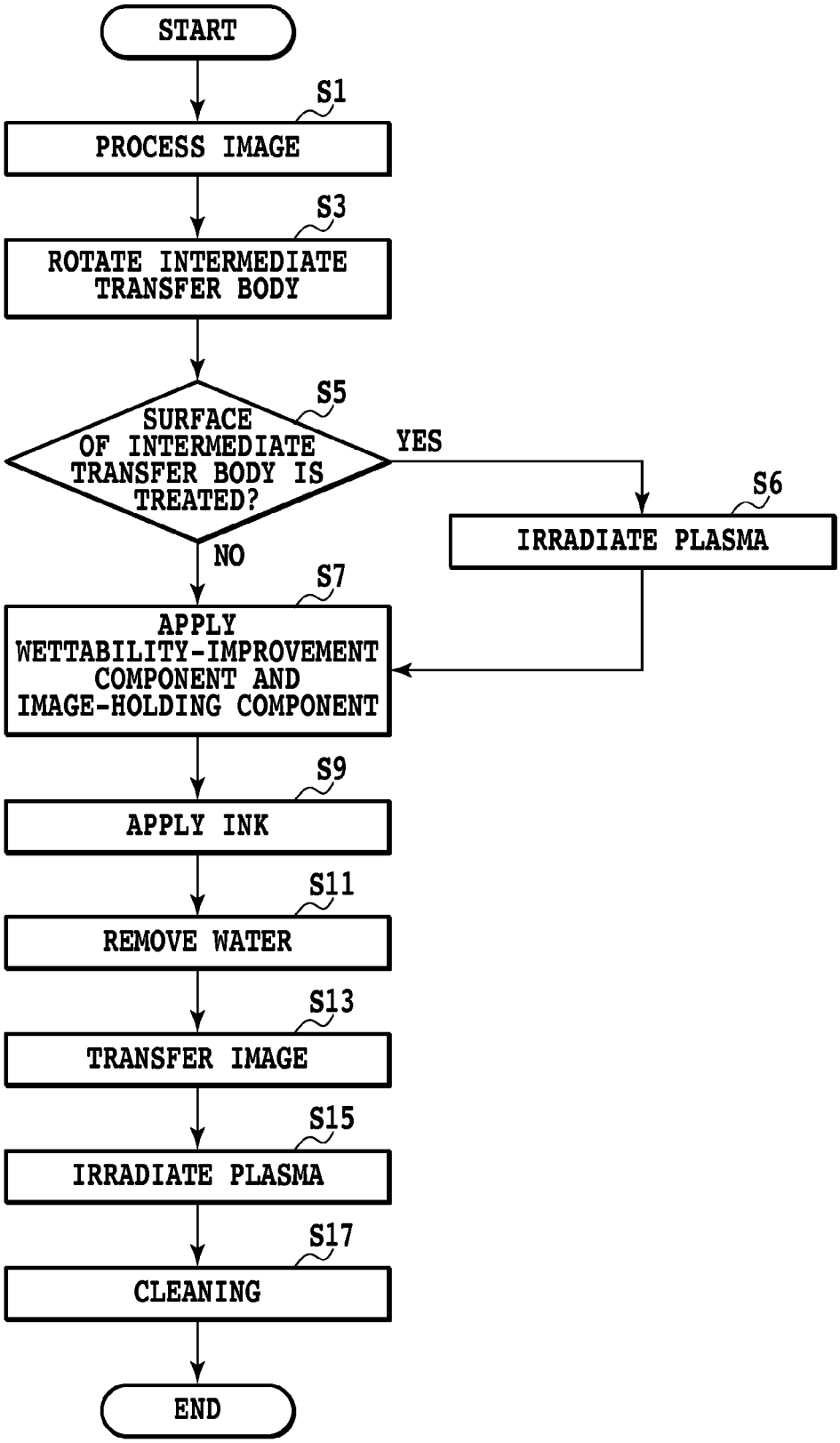
FIG. 3 is a flow chart for describing the image recording operation carried out by the structure shown by FIGS. 1 and 2.

FIG. 3 is a flow chart for explaining the image recording operation carried out by the structure shown in FIGS. 1 and 2, wherein all the steps described above are assembled.

In this operation, a necessary image processing such as the formation of mirror image data or others is first carried out (step S1) and the rotation of the intermediate transfer body 1 is started (step S3). Then, it is determined whether or not the hydrophilic treatment of the surface of the intermediate transfer body 2 is necessary (step S5), and if the determination is affirmative, the plasma irradiation device 3 is operated to carry out the plasma processing onto the intermediate transfer body 1 (step S6).

During the rotation of the intermediate transfer body 1, the wettability-improvement component and the image-holding component are imparted to the surface thereof by the application devices 4 and 5 (step S7), and thereafter, ink is applied from the ink jet head 6 to form the ink image (step S9). When the intermediate transfer body 1 is further rotated, water or a solvent component in the ink forming the image on the intermediate transfer body 1 is removed by the water removal facilitating device 8 or the heat roller 9 (step S11).

Thereafter, a surface to be recorded of the recording medium 10 is in contact with the ink image, and the recording medium is pressed by the pressing roller 11 from the rear surface side, whereby the image is transferred to the recording medium 10 (step S13). The image transferred to the recording medium 10 is subjected to the plasma processing, and fixed onto the recording medium (step S15). After transferring the ink image, the intermediate transfer body 1 is rinsed by the cleaning unit 13 disposed at the next stage for preparing the reception of the next image.

3. Processes Relating to the Inventive Method and Embodiments and Elements Applicable Thereto Next, processes relating to the image fixing method and the producing method for the record according to the present invention and elements applicable thereto will be described in detail. The explanation is made suitably with reference to the structure of the apparatus shown in FIG. 1.

3-1. Printing Means and Processes

According to the present invention, there is no restriction in recording means. An analog printing means such as a planographic offset printing, a relief printing, a gravure printing, a screen printing or a pad printing, or a digital printing system such as an electronic photographic system or the above-mentioned ink jet recording system may be employed. The image may be directly recorded on the recording medium as in a general relief printing, a screen printing or an ink jet printing system, or the image made by a form plate may be indirectly transferred to the printing medium via a blanket or a pad as in a planographic offset printing or a pad printing.

Of them, in the apparatus shown in FIG. 1, an intermediate transfer system using an ink jet recording is employed. That is, recording means or processes includes a process for forming an ink image on the intermediate transfer body and a process for transferring the image to the recording medium.

A configuration of the intermediate transfer body used in such a system may be of a roller type as described above or a belt type. Also, it may be possible to carry out either a continuous processing by using a sheet-like intermediate transfer body or a batch type processing by using a pad type intermediate transfer body. In this regard, the example shown in FIG. 1, a drum type intermediate transfer body made of light metal such as aluminum alloy or others is used in view of the requirement for the rigidity and the dimensional accuracy bearable against the pressure during the transfer and the reduction of rotational inertia.

The surface layer 2 may have the ink permeability if there is no premise that the intermediate transfer body is repeatedly used. However, if it is repeatedly used, impermeable material is used. Even if the material is permeable, the intermediate transfer body made thereof may be repeatedly usable if it can be cleaned by the cleaning operation. The permeable material, however, is low in transfer rate, and therefor more ink is required to be applied to the intermediate transfer body. Accordingly, such material is not preferable in view of the efficiency in the use of material, the deterioration of image quality due to a dot gain (a phenomenon that a dot is largely collapsed by a pressure during the transfer to enlarge its diameter and lower the resolution) and the cleanability of the intermediate transfer body.

From such points of view, the surface layer of the intermediate transfer body is preferably made of ink-impermeable material, more preferably made of material with a good releasability. The releasability is a property wherein ingredients of ink, an image-holding component, a wettability-improvement component or others are difficult to adhere to the surface, and a measure of favorable material is in that a critical surface tension is 30 mN/m or less or a contact angle to water is 75 degrees or more.

More specifically, the surface layer 2 with good releasability may be formed by performing surface treatments, such as coating fluorine on the surface of the intermediate transfer body 1 or applying silicone oil to the surface. However, it is desired that the surface layer 2 is formed of an elastic material with good releasability because it can achieve a higher transfer efficiency. Although a hardness of the elastic rubber of the surface layer depends on the thickness and stiffness of the recording medium 10 in contact with the surface layer and thus it is desirable to optimize the surface layer hardness, the use of the elastic rubber of with a hardness of between 10 and 100 degrees when measured by type A durometer (conforming to JIS K 6253) produces a desirable effect. Almost all kinds of recording media can be dealt with if the elastic rubber has a hardness of between 40 and 80 degrees. For example, the elastic material may advantageously use surface-treated NBR, urethane rubber and chloroprene rubber and also fluororubber, silicone rubber and fluoro silicone rubber each inherently having ink repellent property.

A surface configuration of the surface layer 2 has no particular restriction, and may be selected in view of the surface configuration of the recording medium and the printing effect. For example, if an image like a popular offset print is desired, a flat surface is preferably selected in correspondence to a flat recording paper. Contrarily, if a surface of a rough configuration or gravure cell is used relative to the flat recording medium, it is possible to obtain a printing effect in accordance with uses. It should be noted that, if there is no proviso in the following sentence, a surface of the intermediate transfer body means a surface of the surface layer of the intermediate transfer body.

When the ink jet system is adopted, there is no limitation in the ejection systems. For example, energy used for ejecting ink may be thermal energy (a thermal jet system) or mechanical energy (a piezo system). Other than the on-demand type, a continuous type ink jet recording system may be properly usable. Further, as a shape of the ink jet head, for example, in the structure shown in FIG. 1, a line head type may be used wherein ink jet ejection orifices are arranged in the axial direction of the intermediate transfer body 1 (vertical to the surface of the drawing). Alternatively, an ink jet head wherein ink ejection orifices are arranged in a predetermined range in the tangential direction or the circumferential direction of the intermediate transfer body 1 and the recording is carried out while scanning the same in the axial direction. In addition thereto, a plurality of heads corresponding to the number of ink colors used for forming an image may be used.

Also, there is no limitation in the image to be recorded, including, in addition to letters, illustrations and natural pictures, simple patterns or industrial patterns such as electronic circuits or others. When the image is formed, ink is ejected to form a mirror image by taking the reversal of image due to the transfer into account.

The ink used in the above-mentioned embodiment is one containing a curable component. The curable component is a component polymerized by the cross-linking reaction or the polymeric reaction while receiving energy supplied by the plasma processing. Since it is surmised that the energy supplied by the plasma irradiation device makes material to the exited state, and highly-activated radical thus generated acts to cure as described before, preferable material is one having prepolymer or monomer having radically polymerized unsaturated group. Concretely, unsaturated polyester, unsaturated acryl, epoxyacrylate, urethane acrylate, polyester acrylate, polyether acrylate, polyene/polythiol or others may be cited. Note, in experiments, it has been confirmed that materials other than the above are curable or have the cure-accelerating action, and the materials should not be limited thereto. Accordingly, ink in a wide range including an aqueous type, a non-aqueous type, an oil type or a solvent type may be usable. As a whole, if ink contains a curable component, it is usable for the present invention and other components may be adjustable in accordance with the used image-forming means. In the image recording apparatus shown in FIG. 1, color pigment ink is used wherein pigment is dispersed by water-soluble acrylic resin. An aqueous ink is preferable because it is low in deleterious effect to the environment.

An example of ink usable in the embodiment is preferably an aqueous type having usual dye or pigment and an aqueous liquid medium for dissolving and/dispersing the same. Particularly, pigment ink forms a recorded image having a high fastness, and if an image-holding component described later is used, an especially excellent image is obtainable. Also, if it is desired to obtain solely the printing effect, colorless ink may, of course, be used.

Among possible dyes are C.I. Direct Blue 6, 8, 22, 34, 70, 71, 76, 78, 86, 142, 199, C.I. Acid Blue 9, 22, 40, 59, 93, 102, 104, 117, 120, 167, 229, C.I. Direct Red 1, 4, 17, 28, 83, 227, C.I. Acid Red 1, 4, 8, 13, 14, 15, 18, 21, 26, 35, 37, 249, 257, 289, C.I. Direct Yellow 12, 24, 26, 86, 98, 132, 142, C.I. Acid Yellow 1, 3, 4, 7, 11, 12, 13, 14, 19, 23, 25, 34, 44, 71, C.I. Food Black 1, 2, and C.I. Acid Black 2, 7, 24, 26, 31, 52, 112, 118.

Among possible pigments are C.I. Pigment Blue 1, 2, 3, 15:3, 16, 22, C.I. Pigment Red 5, 7, 12, 48 (Ca), 48 (Mn), 57 (Ca), 112, 122, C.I. Pigment Yellow 1, 2, 3, 13, 16, 83, Carbon Black No. 2300, 900, 33, 40, 52, MA 7, 8, MCF 88 (Mitsubishi Kasei make), RAVEN1255 (Columbia make), REGAL330R, 660R, MOGUL (Cabot make), Color Black FW1, FW18, S170, S150, and Printex35 (Degussa make).

These pigments are free from any limitations in terms of application mode. They can be used in the form of, for instance, self dispersion type (pigment free of dispersant), resin dispersion type and microcapsule type. Suitable pigment dispersions include a water-soluble dispersion resin with a weight-averaged molecular weight of about 1,000 to 15,000. More specifically, they include water-soluble vinyl resin, block or random copolymers and salts thereof made from styrene and its derivatives, vinylnaphthalene and its derivatives, aliphatic alcohol esters of $\alpha,\beta$-ethylenically-unsaturated carboxylic acid, acrylic acid and its derivatives, maleic acid and its derivatives, itaconic acid and its derivatives, or fumaric acid and its derivatives.

To improve the durability of the image formed, a water-soluble resin and a water-soluble cross-linking agent may be added. The only requirement for these materials is that they can coexist with ink components. As the water-soluble resin, the above-mentioned dispersion resins may be suitably used. As the water-soluble cross-linking agent, oxazoline and carbodiimide, which have slow responsivity, may be suitably used in terms of ink stability.

The aqueous liquid medium making up the ink along with the colorants listed above may contain an organic solvent. Preferred organic solvents include the following water-soluble solvents.

The organic solvents may include, for example, polyethylene glycol, polypropylene glycol, ethylene glycol, propylene glycol, butylene glycol, triethylene glycol, thiodiglycol, hexylene glycol, diethylene glycol, ethylene glycol monomethyl ether, diethylene glycol monomethyl ether or glycerin. Two or more of these may be mixed for use. To adjust viscosity and surface tension, alcohols such as ethyl alcohol and isopropyl alcohol or surface active agents may be added to ink. The surfactant used may include cationic surfactant, anionic surfactant, non-ionic surfactant, amphoteric surfactant, fluorinated surfactant and silicone surfactant.

As for a compounding ratio of components making up the ink, there is no limitation. The compounding ratio can be adjusted properly according to the chosen ejection force and nozzle diameters of the ink jet head. The ink may, for example, be composed of 0.1-10% colorant, 0.1-20% resinous component, 5-40% solvent, 0.01-5% surface active agent and the remaining percentage of purified water.

In the image recording apparatus shown in FIG. 1, it is possible to apply the image-holding component to the intermediate transfer body 1 by using the application device 5 prior to the formation of the ink image. A reason therefor is to control the ink fluidity. When the surface layer of the intermediate transfer body has no ink-absorbency, there is a problem in that an ink stream may occur because the ink is fluidized to result in drawbacks such as bleeding or beading. The image-holding component is a component wherein, if in contact with ink, colorant or resin that is part of the compound forming ink is chemically reacted thereto or physically absorbed therein, the fluidity of the ink is reduced as a whole. The image-holding component is not limited to the above-mentioned one that reduces the fluidity as a whole, but may be one that locally restricts the fluidity due to the agglomeration of solid component of the ink compound.

The ink viscosity increasing component should properly be chosen according to the kind of ink used for image forming. For a dye ink, for instance, it is effective to use a polymer coagulant. For a pigment ink having fine dispersed particles, it is effective to use a metal ion. Further, if the dye ink containing the image-holding component having a combination of the polymer coagulant with the metal ion is used, it is preferred that a pigment component of an identical color with that of the dye component be mixed into the ink, or that white or transparent fine particles which have little effects on the color be added.

The polymer coagulants used as the image-holding component include, for example, cationic polymer coagulants, anionic polymer coagulants, nonionic polymer coagulants and amphoteric polymer coagulants. Metal ions include, for example, divalent metal ions such as $Ca^{2+}$, $Cu^{2+}$, $Ni^{2+}$, $Mg^{2+}$ and $Zn^{2+}$, and trivalent metal ions such as $Fe^{3+}$ and $Al^{3+}$. If a liquid containing these metal ions is applied, it is preferably applied in the form of a metal salt solution in water. Among anions of metal salts are $Cl^-$, $NO_3^-$, $SO_4^{2-}$, $I^-$, $Br^-$, $ClO_3^-$ and $RCOO^-$ (R represents an alkyl group). Material having a property reverse to the used ink is usable as the image-holding component. For example, if the ink is anionic or alkaline, cationic or acidic material is usable as an image-holding component.

The application device 5 is not limited to a roll coater type as shown in FIG. 1, but may be any of the conventional ones. For example, a spray coater or a slit coater may be used. Also, a recording head of an ink jet type ejecting liquid having a high viscosity may be suitably used when it is desired to vary an application area in accordance with output images.

When the image-holding component is applied, surfactant, solvent, resinous component, cross-linking agent or others may be mixed therewith in the same manner as ink.

Further, prior to applying the image-holding component, the wettability of the surface of the intermediate transfer body may be facilitated. In the image recording apparatus shown in FIG. 1, it is possible to apply the component for facilitating the wettability by using the application device 4. By the application of the component for facilitating the wettability, it is possible to uniformly impart the image-holding component to the intermediate transfer body. Surfactant may be suitably used as the component for facilitating the wettability. There is no limitation in the usable surfactants. For example, from a group of conventional cationic surfactant, anionic surfactant, nonionic surfactant, ampholytic surfactant, fluorine type surfactant and silicone type surfactant, suitable surfactant may be selected in accordance with the surface layers to be used. Of them, fluorine type or silicone type is effective and suitable material. Similar to the application device 5, there is no limitation in the application means and the conventional technique may be used. That is, a roll coater, a spray coater, a slit coater or others may be usable. Also, it is possible to use a head of the ink jet type so that the application area is changed in accordance with the output images.

Further, non-liquid type surfactant may be used. For example, the component for facilitating the wettability may be applied to the surface of the intermediate transfer body by bringing solid or waxy surfactant into contact with the surface of the intermediate transfer body.

In this regard, among the above-mentioned components applied prior to forming the ink image, there are those which are better to be dried before the ink is ejected. In such a case, a suitable delay time is provided between the application of those components and the ejection of ink. In the apparatus shown I FIG. 1, it is possible to properly decelerate or stop the rotation of the intermediate transfer body 1.

In the recording apparatus shown in FIG. 1, there is the process for transferring the ink image formed on the intermediate transfer body 1 to the recording medium. That is, the ink image formed on the intermediate transfer body 1 is brought by the pressing roller 10 into contact with a surface to be recorded of the recording medium 9 and transferred thereto. According to the construction shown in FIG. 1, since the ink has become highly viscous on the intermediate transfer body 1 by this stage, it is possible to favorably record the image even on a recording paper sheet having low ink-absorbency or on a recording medium having no ink-absorbency such as plastic film.

If the ink is not sufficiently viscous, it is favorable to increase the viscosity by the water removal facilitating device 8 of a blower type and/or the heat roller 9 disposed in a passage between the formation of ink image and the transfer thereof. On the other hand, to prevent the ink from excessively highly being viscous, means may be provided for suppressing the volatilization of ink solvent or for adjusting the volatility of ink solvent.

3-2. Fixing of Image

It is possible to polymerize the curable component in the ink by applying the above-mentioned energy generated from the plasma processing that is a main characteristic of the present invention to the ink image transferred to the recording medium, and complete the record having a sufficient image fastness. According to the apparatus shown in FIG. 1, the device 3 irradiating plasma at a normal pressure carries out such an operation, disposed at a position wherein the recording medium after the image is transferred thereto is released from the surface layer 2 of the intermediate transfer body. The position of the plasma irradiation device 3 is a position capable of applying energy also to the recorded surface of the recording medium 10 after the image is transferred thereto and the surface layer 2 of the intermediate transfer body, whereby it is possible to enhance the surface energy of the intermediate transfer body as described before.

4. Examples

Next, more concrete Examples of the present invention and Comparative examples thereof will be described below. In this regard, "part" and "%" in the following description are based on the weight unless there is the explanation contrary thereto.

(4.1) Example 1

Recording Process

According to this Example, an ink prepared by the following recipe was supplied to a roller, and the ink on the roller was transferred to a recording paper via a blanket to produce a record product.

(Offset Ink)

Carbon black: 20 parts
Alkali-blue toner: 4 parts
Phthalocyanine blue: 2 parts
Rosin-modified phenol resin: 30 parts
Linseed oil: 10 parts
High-boiling point petroleum solvent (boiling point: about 260° C.): 30 parts
Drier (cobalt or manganese type): 2 parts
Compound: 2 parts (Printed Paper)

Art paper (ream weight JIS P 0001: 62.5 g)

Fixing Process

Next, the record is equally cut into two pieces, and one of them is subjected to the plasma irradiation under the following conditions to fix the image. This is referred to as a test piece 1A.

(Conditions of Plasma Irradiation)

Processing pressure: normal pressure
Introduced gas: nitrogen gas 0.5 l/min
Processing voltage: 230 V
Processing current: 1.85 A
Processing frequency: 30 kHz
Processing speed: 70 mm/sec Comparative Example On the other hand, another piece of the record not subjected to the plasma irradiation is referred to as a test piece 1B.

Fixing Ability Estimation Test

The test pieces 1A and 1B thus obtained were tested by an abrasion tester (the tests were repeated 50 times under a load of 200 g). As a result, it was found that there is no deterioration of the letter image in the test piece 1A to maintain the favorable readability. On the contrary, in the test piece 1B, the image is disturbed whereby the readability of the image is significantly deteriorated.

(4.2) Example 2

Recording Process

A marketed ink jet printer was used and a photographic image was formed on an exclusive OHP film (manufactured by CANON K.K.: CF-102) with inks (four color inks containing color dyes as colorant) of the following recipe. Note there was no transfer process in this Example.

(Ink Recipe)

Dyes described below: 4 parts
Black: C.I. Food Black 2
Cyan: C.I. Direct Blue 199
Magenta: C.I. Acid Red 289
Yellow: C.I. Acid Yellow 23
Styrene/acrylic acid/ethyl acrylate copolymer (acid value of 240, weight-average molecular weight of 5000): 2 parts
Glycerin: 10 parts
Ethylene glycol: 5 parts
Surfactant (manufactured by KAWAKEN Fine Chemicals: Acetylenol EH): 1 part
Ion exchanging water: 78 parts Fixing Process Next, the recorded OHP film was equally cut into three pieces, one of which was irradiated with plasma under the following conditions to fix the ink image. This is referred to as a test piece 2A.

(Conditions of Plasma Irradiation)

Processing pressure: normal pressure
Introduction gas: nitrogen gas of 0.5 l/min
Processing voltage: 230 V
Processing current: 1.85 A
Processing frequency: 30 kHz
Processing speed: 100 mm/sec Comparative Example Another one of the pieces was not subjected the plasma irradiation and referred to as a test piece 2B. A final one thereof was irradiated with infra-red ray by an IR heater under the following conditions to prepare a test piece 2C.

(Conditions of Ultraviolet Ray Irradiation)

Applied voltage: 90 V
Applied current: 5 A
Processing speed: 100 m/sec

Fixing Ability Estimation Test

The test pieces 2A, 2B and 2C thus obtained were tested by an abrasion tester (the tests were repeated 50 times under a load of 200 g) to estimate the fixing ability. As a result, it was found that there are no disturbance in the image and no damage in the OHP film of the test piece 2A. In the test piece 2B, the image was disturbed to significantly degrade the quality level of the image. In the test piece 2C, while there was no disturbance in the image, the OHP film was waved by heat.

(4.3) Example 3

Recording Process

According to this Example, in the apparatus shown in FIG. 1, an aluminum drum coated with silicone rubber (manufactured by SHIN-ETUS Chemicals: KE30) of 0.5 mm thick having a rubber hardness of 60° was used as an intermediate transfer body. First, the surface of the intermediate transfer body was irradiated with plasma by the plasma irradiation device provided as a fixing device under the following conditions.

(Conditions of Plasma Irradiation)

Processing pressure: normal pressure
Introduction gas: nitrogen gas of 0.5 l/min
Processing voltage: 230 V
Processing current: 1.70 A
Processing frequency: 30 kHz
Processing speed: 120 mm/sec Next, the following aqueous solution was coated on the intermediate transfer body with a roll coater.

(Aqueous Solution)

Calcium chloride 2-hydrate: 10 parts
Fluorine type surfactant (manufactured by SEIMI Chemical: Surflon S-141): 1 part
Cross-linker (manufactured by NISSHINBO K.K.: Carbodilite V-02): 1 part
Ion exchanging water: 88 parts Next, a mirror-reversal photographic image was formed on the intermediate transfer body with four color inks (containing the respective pigments as colorant) of the following recipe using an ink jet recording apparatus (a nozzle arrangement density of 1200 dpi, an ejection rate of 4 pl, and a driving frequency of 8 kHz).

(Ink Recipe)

The following pigments: each 5 parts
Black: carbon black (manufactured by Mitsubishi Chemicals: MCF 88)
Cyan: Pigment Blue 15
Magenta: Pigment Red 7
Yellow: Pigment Yellow 74
Styrene/acrylic acid/ethyl acrylate copolymer (acid value of 240, weight-average molecular weight of 5000): 1 part
Glycerin: 10 parts
Ethylene glycol: 5 parts
Surfactant (manufactured by KAWAKEN Fine Chemicals: Acetylenol EH): 1 part
Ion exchanging water: 78 parts Transfer Process Hot air was blow from a blower type water removal facilitating device 8 provided between the ink jet head 6 and the pressing roller 11 to the image-forming surface of the intermediate transfer body to reduce the water in the ink image. Thereafter, the intermediate transfer body and a recording paper sheet (manufactured by NIPPON SEISHI: Npi Coat, ream weight of 40.5) were brought into contact with each other by a pressing roller to transfer the ink image.

Fixing Process

The record to which the image is transferred was subjected to the plasma irradiation under the following conditions by the plasma irradiation device 3.

(Conditions of Plasma Irradiation)

Processing pressure: normal pressure
Introduction gas: nitrogen gas of 0.5 l/min
Processing voltage: 230 V
Processing current: 1.7 A
Processing frequency: 30 kHz
Processing speed: 100 mm/sec Comparative Example The record obtained by the processes as far as the transfer process in the same manner as Example 3 was taken out without being subjected to the fixing process (plasma processing) as a test piece 3B.

Fixing Ability Estimation Test

The fixing ability of the test pieces 3A and 3B thus obtained was estimated through tests by an abrasion tester (under a load of 200 g, 50 times) while maintaining 10 minutes from the transfer of ink image to the initiation of abrasion test. As a result, it was found that the fixing ability of the test piece 3A was better than that of the test piece 3B.

5. Second Embodiment

According to the first embodiment, the intermediate transfer system of the ink jet recording type was employed, including a process for forming an ink image on an intermediate transfer body and a process for transferring the image to a recording medium. As described above, however, there is no limitation in recording means in the present invention, and also the image recording should not be restricted to the intermediate transfer system. That is, a direct recording system may be employed wherein an image is directly recorded on a surface of the recording medium 10 to be recorded.

Figure 4:
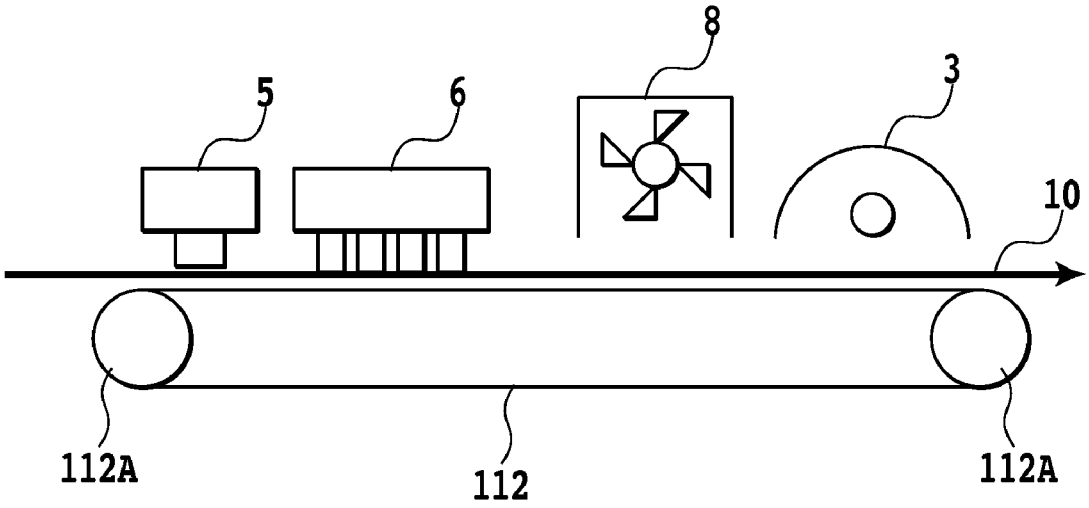
FIG. 4 is a schematic view illustrating a main structure of the image-forming apparatus according to another embodiment of the present invention.

FIG. 4 illustrates one instance of an image recording apparatus according to such an embodiment wherein the same reference numerals are used for denoting parts having the same functions as in the first embodiment. Also, it is, of course, possible to carry out the suitable modification of the respective parts or the proper addition thereto.

In this instance, the recording medium 10, which surface to be recorded is opposed upward, is conveyed beneath an image-holding component application device 5, an ink jet head 6, a water removal facilitating device 8 and a plasma irradiation device 3, while supported by a conveyor belt 112 extended between a pair of conveyor rollers 112A.

Figure 5:
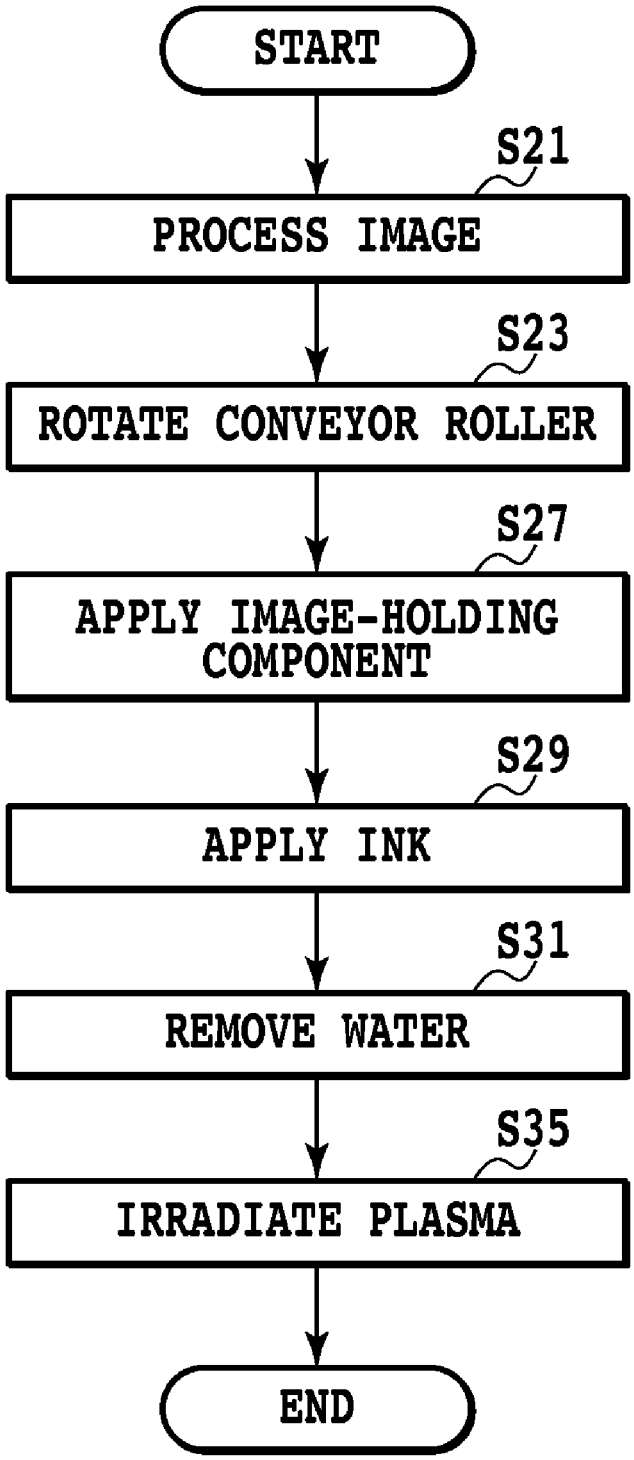
FIG. 5 is a flow chart explaining the image-recording operation carried out by the structure shown by FIG. 4.

FIG. 5 is a flow chart for explaining the operation for recording an image according to this embodiment. In this operation, the necessary processing of the image such as the formation of image data is initially carried out (step S21) and the drive of the conveyor rollers 112A or the conveyor belt 112 is started (step S23). During the conveying process of the recording medium 10 accompanied therewith, an image-holding component is applied from the device 5 to the surface of the recording medium (step S27), and then ink is ejected from the ink jet head 6 to record the image (step S29). While the recording medium 10 is further conveyed, water or a solvent component in the ink forming the image is removed by the water removal facilitating device 8 (step S31). Then, the recorded image is subjected to a plasma processing and fixed (step S35).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-161342, filed Jun. 9, 2006, which is hereby incorporated by reference herein in its entirety.

The invention claimed is:

1. A method for producing a record product, comprising the steps of:

subjecting an intermediate transfer body to plasma processing by using a plasma irradiation device;

forming an image on the intermediate transfer body with a recording material containing a component curable by a plasma processing;

transferring the image formed on the intermediate transfer body to a recording medium: and carrying out the plasma processing to the recording medium transferred image by using the plasma irradiation device that is used in said subjecting step.

2. A method as claimed in claim 1, further comprising a step of agglomerating a component in the recording material applied to the intermediate transfer body.

* * * * *